US006347622B1

(12) United States Patent
Hsueh

(10) Patent No.: US 6,347,622 B1
(45) Date of Patent: Feb. 19, 2002

(54) PAINT BULLET GUN

(76) Inventor: Chieh-Lung Hsueh, 2, Sublane 15, Lane 118, Min Chuan W. Road, Taipei (TW)

( * ) Notice: Subject to any disclaimer, the term of this patent is extended or adjusted under 35 U.S.C. 154(b) by 0 days.

(21) Appl. No.: 09/690,723

(22) Filed: Oct. 18, 2000

(51) Int. Cl.[7] ..... F41B 11/00; F41B 11/02

(52) U.S. Cl. ..... 124/49; 124/31; 124/74; 124/83

(58) Field of Search ..... 124/31, 45, 49, 124/73, 74, 83

(56) References Cited

U.S. PATENT DOCUMENTS 1,205,166 A * 11/1916 Dettra
2,640,476 A * 6/1953 Spink
3,717,947 A * 2/1973 Nomura
3,789,891 A * 2/1974 Bosch
4,936,282 A * 6/1990 Dobbins et al. ..... 124/74
5,673,679 A * 10/1997 Walters ..... 124/73 X
5,896,850 A * 4/1999 Sullivan ..... 124/74
6,273,079 B1 * 8/2001 Jzn ..... 124/49

* cited by examiner

*Primary Examiner*—John A. Ricci
(74) *Attorney, Agent, or Firm*—Troxell Law Office PLLC

(57) ABSTRACT

A paint bullet gun is constructed to include a gun body, a stock, a trigger, a bullet loading guide, a rear sight rack, and a carburetion chamber, wherein the gun body is formed of an upper gun barrel and a lower barrel, the upper gun barrel having a top bullet loading hole, a plurality of recessed holes longitudinally aligned at a top side thereof, a side slot, and a rubber stop mounted in the side slot and adapted to stop the loaded paint bullets in position; the bullet loading guide is sleeved onto the upper gun barrel to hold the rubber stop in the side slot, having a plurality of fixing devices, which are respectively fastened to the recessed holes of the upper gun barrel to fix said bullet loading guide to the upper gun barrel, the fixing devices each having a compression spring, and a steel ball supported on the compression spring at a bottom side and forced by the compression spring into engagement with one recessed hole of the upper gun barrel.

7 Claims, 5 Drawing Sheets

PAINT BULLET GUN

BACKGROUND OF THE INVENTION

The present invention relates to a paint bullet gun and, more particularly, to such a paint bullet gun, which can easily quickly be assembled or disassembled and, can be attached with an auxiliary trigger for firing operation with two fingers.

FIG. 1 shows a paint bullet gun according to the prior art. This structure of paint bullet gun comprises an upper gun barrel 1', a bullet loading guide 2' welded to the upper gun barrel 1' at the top side, a rubber stop 12' inserted into a side slot 11' on the upper gun barrel 1' to stop loaded paint bullets in position, and a guard plate 3' fastened to the upper gun barrel 1' by screws to hold the rubber stop 12' in the side slot 11'. Because the upper gun barrel 1' is made of aluminum alloy, making screw holes on the upper gun barrel 1' may weaken the structural strength of the upper gun barrel 1' and affect the precision of the rifling. When pressing the trigger to fire a paint bullet, the air valve is opened, enabling a flow of compressed gas to pass out of the gas cylinder and to drive one paint bullet out of the upper gun barrel into the air. Because the flow rate of compressed gas is fixed in factory, the paint bullet driving force is not adjustable. Further, because the size of the trigger is also fixed during the design of the paint bullet gun, the user cannot adjust the length of the trigger to fit different requirements.

SUMMARY OF THE INVENTION

The invention has been accomplished under the circumstances in view. According to one aspect of the present invention, the bullet loading guide is shaped like a split barrel sleeved onto the upper gun barrel of the gun body to hold the rubber stop in the side slot of the upper gun barrel, having a plurality of fixing devices, which fix the bullet loading guide to the upper gun barrel. Each fixing device comprises a compression spring, and a steel ball supported on the compression spring at a bottom side and forced by the compression spring into engagement with one recessed hole on said upper gun barrel. According to another aspect of the present invention, the stock of the paint bullet gun comprises a downwardly extended locating rod, the locating rod having two eyelets bilaterally disposed at a bottom side thereof, and a trigger guard, the trigger guard having one end pivoted to the stock and an opposite end provided with two spring-supported steel balls adapted for engaging into the eyelets of the locating rod. The trigger guard can be disconnected from the locating rod, so that an auxiliary trigger can be fastened to the trigger to extend its length for easy operation with multiple fingers.

DETAILED DESCRIPTION OF THE PREFERRED EMBODIMENT

Figure 1:
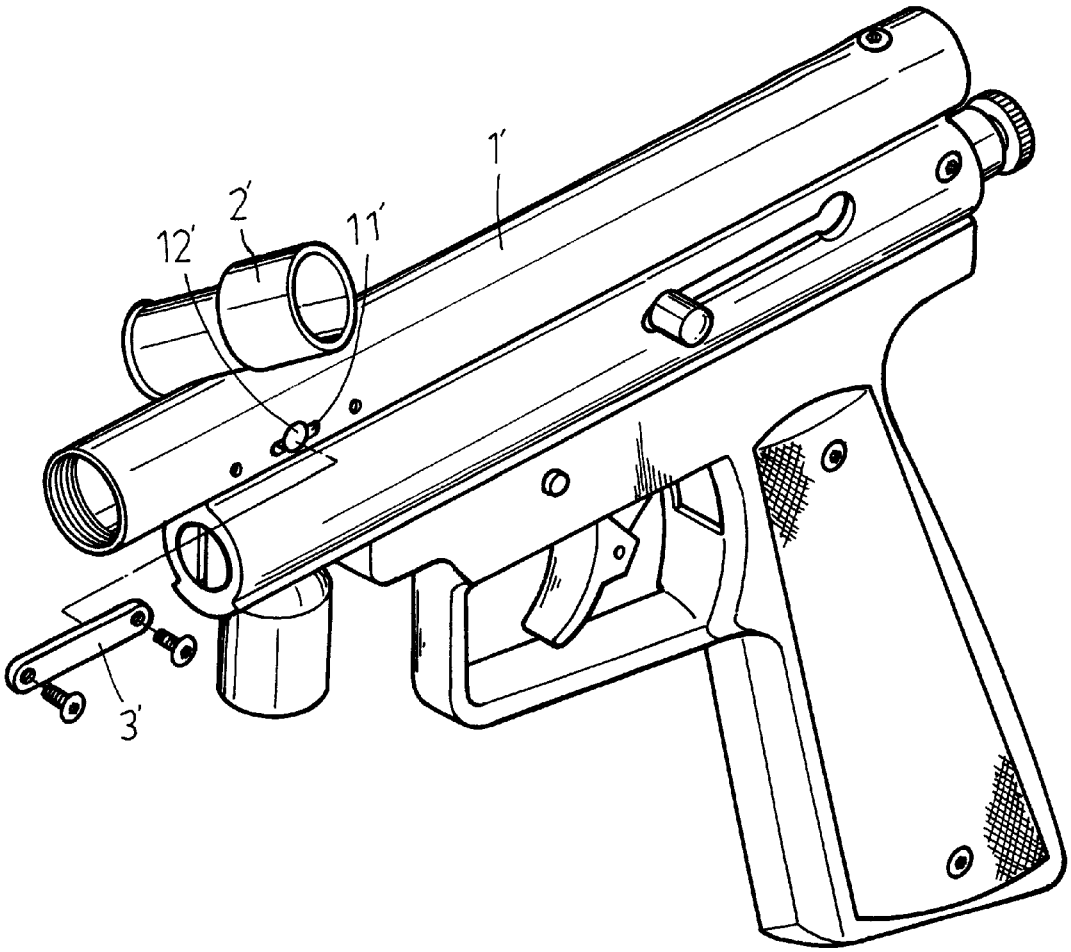
Prior Art FIG. 1
FIG. 1 is a perspective view of a paint bullet gun according to the prior art.
Figure 2:
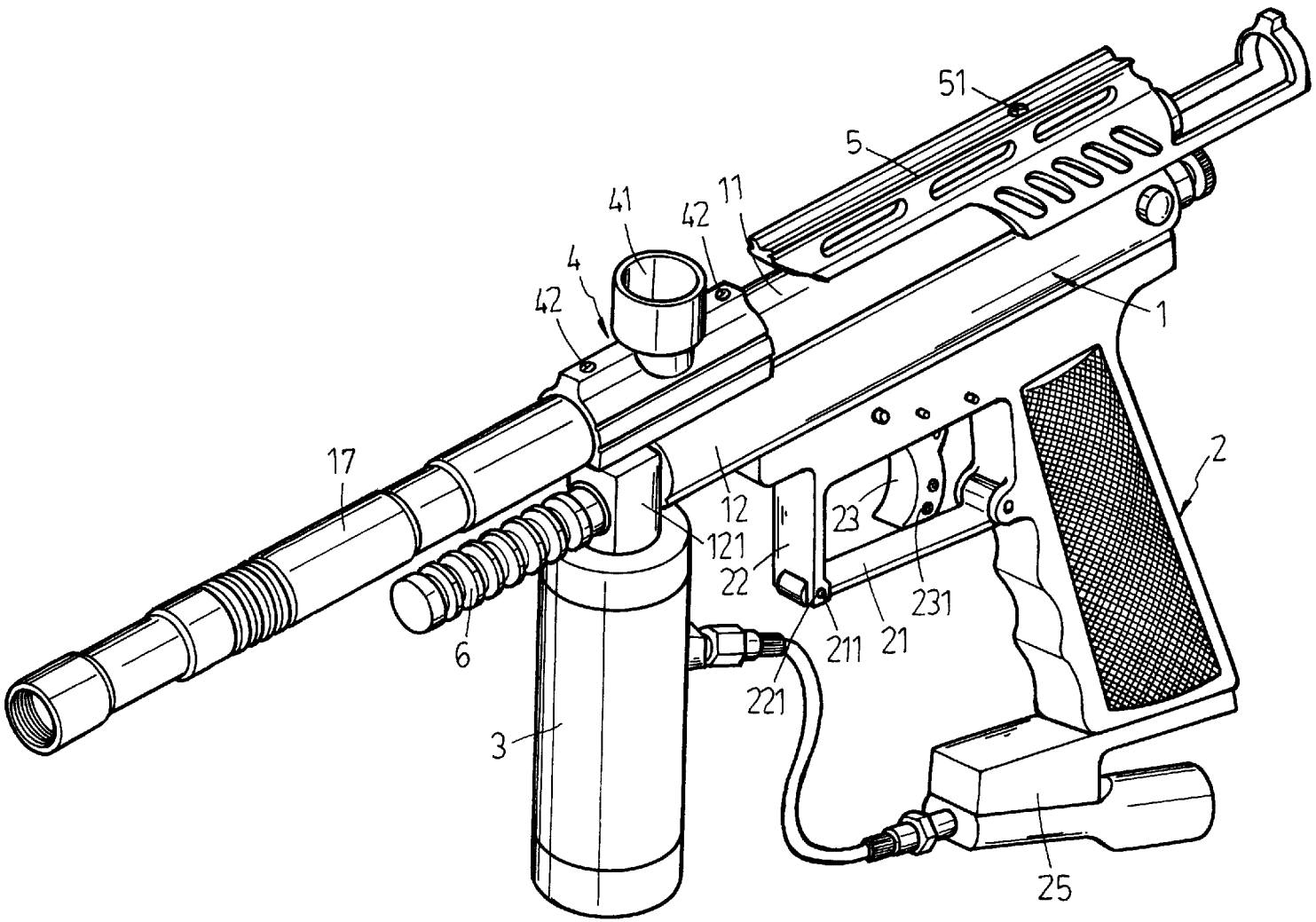
FIG. 2 is a perspective view of a paint bullet gun according to the present invention.
Figure 3:
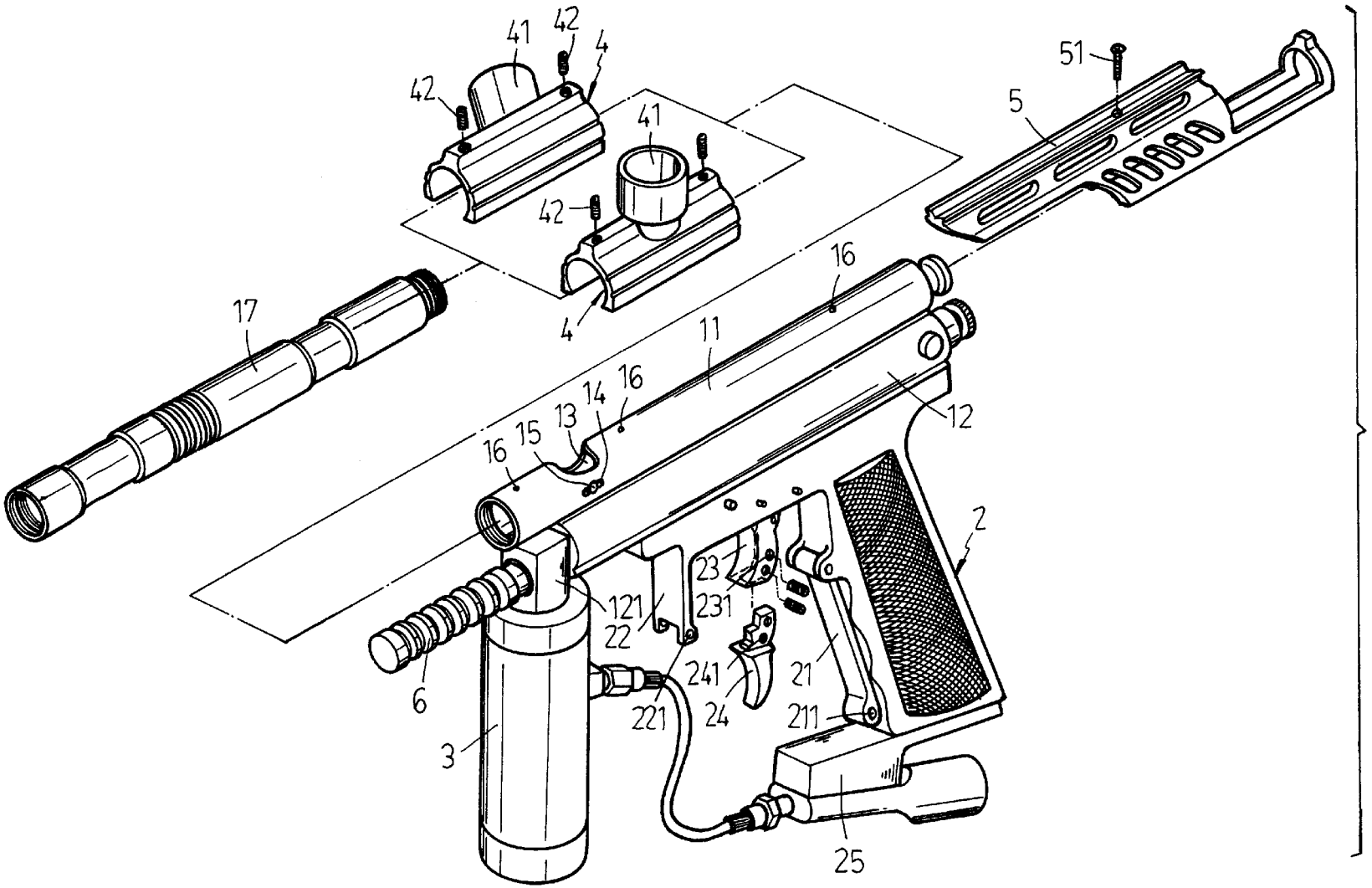
FIG. 3 is an exploded view of the paint bullet gun shown in FIG. 2.
Figure 4:
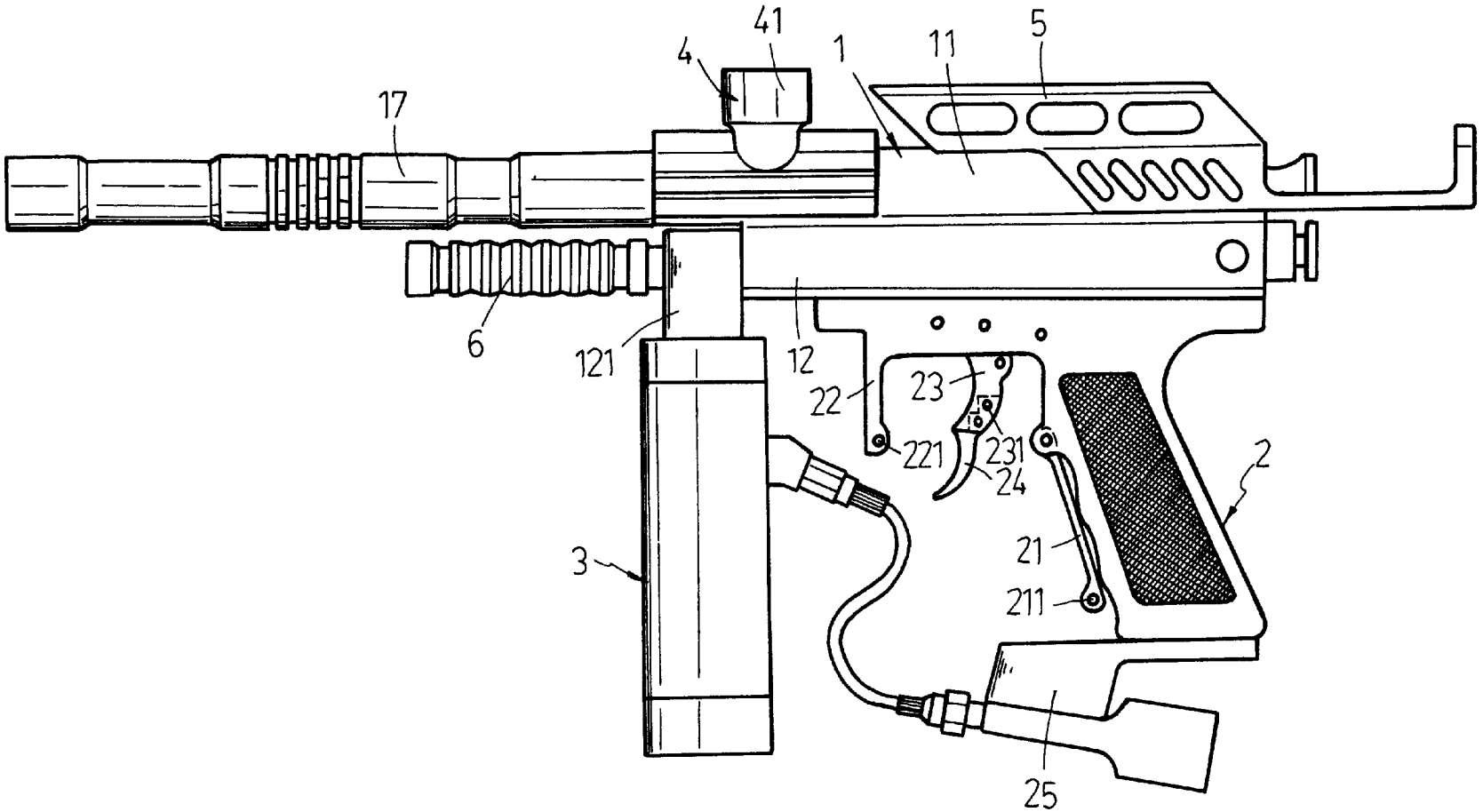
FIG. 4 is a side plain view of the present invention, showing the trigger guard disconnected from the locating rod, the auxiliary trigger fastened to the trigger.

Referring to FIGS. from 2 through 4, a paint bullet gun in accordance with the present invention is shown comprised of a gun body 1, a stock 2, an air flow rate regulation handgrip 3, a bullet loading guide 4, a rear sight rack 5, and a carburetion chamber 6. The gun body 1 is disposed at the topside of the stock 2, comprising an upper gun barrel 11 and a lower gun barrel 12. The lower gun barrel 12 has a front air inlet 121, which receives the air flow rate regulation handgrip 3. The rear side of the upper gun barrel 11 supports the rear sight rack 5. The air flow rate regulation handgrip 3 controls the flow rate of nitrogen gas being delivered to the gun body 1. The rear sight rack 5 is adapted to hold a rear sight, and to shield the reciprocating stroke of the firing pin. The carburetion chamber 6 is installed in the front side of the lower barrel 12 and adapted to increase the amount of the carburetion of $CO_2$. The upper gun barrel 11 comprises a bullet loading hole 13 at the top side near the front end, a slot 14 adjacent to one lateral side of the bullet loading hole 13, a rubber stop 15 mounted in the slot 14 and adapted to stop the inserted paint bullet in position, a plurality of recessed holes 16 longitudinally aligned at the top side, and a front extension barrel 17 adapted to increase the range of projectile.

The stock 2 comprises a trigger guard 21, a downwardly extended locating rod 22, a trigger 23, and a holder 25. The locating rod 22 has two eyelets 221 bilaterally disposed at the bottom side thereof. The trigger guard 21 has one end pivoted to the stock 2, and an opposite end mounted with two spring-supported steel balls 211 adapted for engaging into the eyelets 221 of the locating rod 22. The trigger 23 comprises a plurality of mounting holes 231. After disconnection of the trigger guard 21 from the locating rod 22, an auxiliary trigger 24 can be connected to the trigger 23 at the bottom side for firing operation with two fingers. The auxiliary trigger 24 comprises a plurality of mounting holes 241 respectively fastened to the mounting holes 231 of the trigger 23 by screws. The holder 25 is adapted to hold a nitrogen cylinder.

The bullet-loading guide 4 is mounted on the upper gun barrel 11 over the bullet-loading hole 13. Further, fixing devices 42 and 51 are respectively installed in the bullet loading guide 4 and the rear sight rack 5 and engaged into the recessed holes 16 to secure the bullet loading guide 4 and the rear sight rack 5 to the upper gun barrel 11. The bullet-loading guide 4 comprises a receptacle 41 disposed in communication with the bullet-loading hole 13 and adapted to receive a paint bullet magazine. The receptacle 41 can be made perpendicularly raised from the topside of the bullet-loading guide 4, or obliquely raised from the topside of the bullet-loading guide 4 at 45° angle of elevation.

Figure 5:
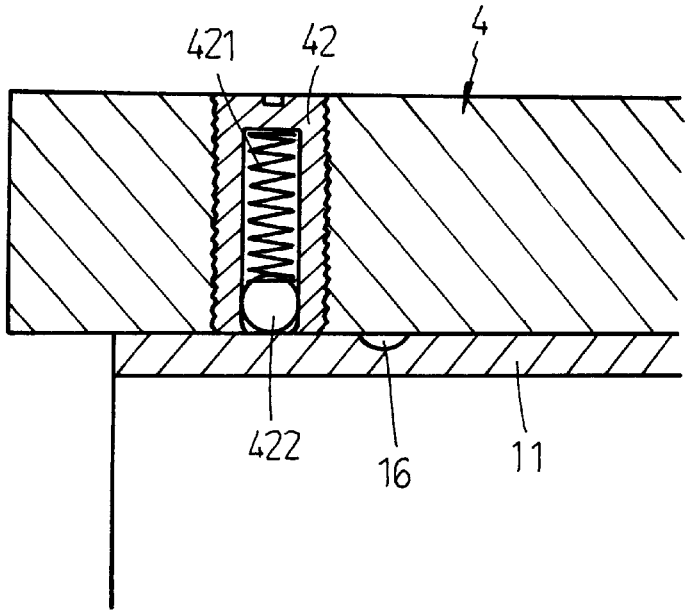
FIG. 5 is a sectional view in an enlarged scale of a part of the present invention, showing the installation of the bullet-loading guide in the upper gun barrel.
Figure 6:
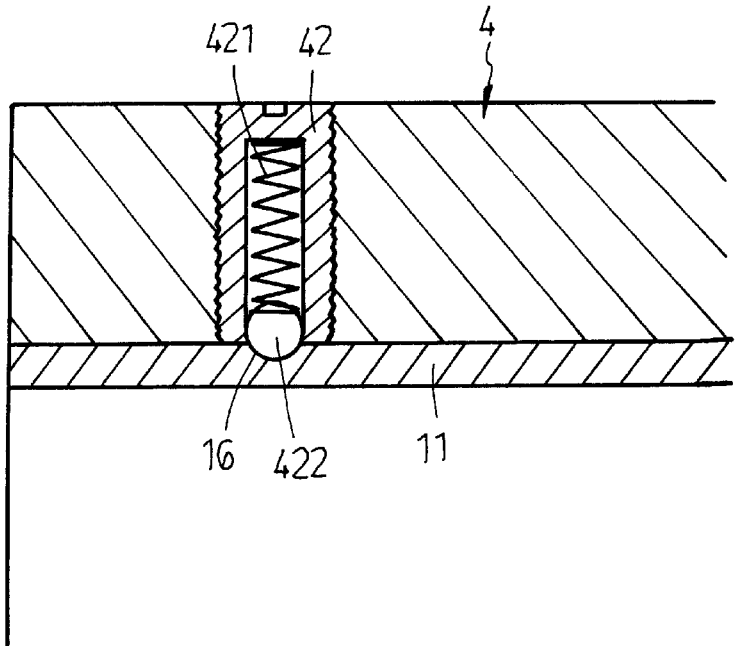
FIG. 6 is similar to FIG. 5 but showing the steel ball of the fixing device engaged into the corresponding recessed hole of the upper gun barrel.

Referring to FIGS. 5 and 6, the fixing device 42 holds a compression spring 421 and a steel ball 422 at the bottom side of the compression spring 421. The compression spring 421 pushes the steel ball 422 out of the bottom side of the fixing device 42 into engagement with one recessed hole 16 of the upper gun barrel 11. The bullet-loading guide 4 is shaped like a split tube sleeved onto the upper gun barrel 11. After having been set into position, the steel ball 422 of each fixing device 42 is forced into engagement with the corresponding recessed holes 16 of the upper gun barrel 11, and therefore the bullet-loading guide 4 is positively secured to the upper gun barrel 11. After installation of the bullet-loading guide 4 in the upper gun barrel 11, the bullet loading guide 4 stop the rubber stop 15 in the slot 14. The rear sight rack 5 is fastened to the upper gun barrel 11 in same manner as the bullet-loading guide 4.

It is to be understood that the drawings are designed for purposes of illustration only, and are not intended for use as a definition of the limits and scope of the invention disclosed.

What the invention claimed is:

1. A paint bullet gun comprising a gun body, a stock, a trigger, a bullet loading guide, a rear sight rack, and a carburetion chamber, wherein said gun body comprises an upper gun barrel and a lower gun barrel, said upper gun barrel comprising a top bullet loading hole, a plurality of recessed holes longitudinally aligned at a top side thereof, a side slot, and a rubber stop mounted in said side slot and adapted to stop the loaded paint bullets in position; said bullet loading guide is sleeved onto said upper gun barrel to hold said rubber stop in said side slot, comprising a plurality of fixing devices, which are respectively fastened to the recessed holes of said upper gun barrel to fix said bullet loading guide to said upper gun barrel, said fixing devices each comprising a compression spring, and a steel ball supported on said compression spring at a bottom side and forced by said compression spring into engagement with one recessed hole of said upper gun barrel.

2. The paint bullet gun of claim 1 wherein said stock comprises a downwardly extended locating rod, said locating rod having two eyelets bilaterally disposed at a bottom side thereof, a trigger guard, said trigger guard having one end pivoted to said stock and an opposite end provided with two spring-supported steel balls adapted for engaging into the eyelets of said locating rod.

3. The paint bullet gun of claim 2 further comprising an auxiliary trigger adapted for fastening to said trigger by screws after disconnection of said trigger guard from said locating rod.

4. The paint bullet gun of claim 1 wherein said rear sight rack is sleeved onto said upper gun barrel, comprising a fixing device, which is fastened to one recessed hole of said rear sight rack to said upper gun barrel, the fixing device of said rear sight rack comprising a compression spring, and a steel ball supported on the compression spring at a bottom side and forced by the compression spring into engagement with one recessed hole of said upper gun barrel.

5. The paint bullet gun of claim 1 wherein said bullet loading guide comprises a receptacle disposed in communication with the bullet loading hole of said upper gun barrel and adapted to receive a paint bullet magazine.

6. The paint bullet gun of claim 5 wherein said receptacle is perpendicularly raised from a top side of said bullet-loading guide.

7. The paint bullet gun of claim 5 wherein said receptacle is obliquely raised from a top side of said bullet loading guide at a 45 degree angle of elevation.

* * * * *